United States Patent [19]

Dickakian

[11] Patent Number: 4,503,026

[45] Date of Patent: Mar. 5, 1985

[54] SPINNABLE PRECURSORS FROM PETROLEUM PITCH, FIBERS SPUN THEREFROM AND METHOD OF PREPARATION THEREOF

[75] Inventor: Ghazi Dickakian, Greenville, S.C.

[73] Assignee: E. I. Du Pont de Nemours and Company, Wilmington, Del.

[21] Appl. No.: 475,068

[22] Filed: Mar. 14, 1983

[51] Int. Cl.[3] ..... D01F 9/12

[52] U.S. Cl. ..... 423/447.4; 423/447.6; 208/22; 208/45

[58] Field of Search ..... 423/447.1, 447.2, 447.4, 423/447.6, 447.7, 447.8; 208/22, 45; 264/29.2

[56] References Cited

U.S. PATENT DOCUMENTS

| | | | |
|---|---|---|---|
| 4,219,404 | 8/1980 | Dickakian | 208/39 |
| 4,271,006 | 6/1981 | Dickakian | 208/45 |
| 4,277,324 | 7/1981 | Greenwood | 423/447.4 |
| 4,363,715 | 12/1982 | Dickakian | 208/45 |

*Primary Examiner*—John Doll
*Assistant Examiner*—Steven Capella

[57] ABSTRACT

A spinnable precursor from petroleum pitch is obtained by isolating a particular fraction of a molten carbonaceous pitch, which has had at least a portion of the polycondensed aromatic oils normally present in the pitch removed. The deoiled pitch is then subjected to a two-stage extraction in an organic solvent in which it has a reversed solubility curve, followed by thermal treatment. The thus obtained precursor can be directly spun into fiber.

10 Claims, No Drawings

SPINNABLE PRECURSORS FROM PETROLEUM PITCH, FIBERS SPUN THEREFROM AND METHOD OF PREPARATION THEREOF

BACKGROUND OF THE INVENTION

The present invention is generally concerned with the preparation of a feedstock for carbon artifact manufacture from carbonaceous residues of petroleum origin including distilled or cracked residium of crude oil and hydrodesulfurized residues of distilled or cracked crude oil and to the use of that feedstock for carbon artifact manufacture, including fiber preparation.

Carbon artifacts have been made by pyrolyzing a wide variety of organic materials. It should be appreciated that this invention has applicability to carbon artifact formation generally and most particularly to the production of shaped carbon articles in the form of filaments, yarns, films, ribbons, sheets and the like.

The use of carbon fibers in reinforcing plastic and metal matrices has gained considerable commercial acceptance where the exceptional properties of the reinforcing composite materials such as their higher strength to weight ratio clearly offset the generally high costs associated with preparing them. It is generally accepted that large-scale use of carbon fibers as a reinforcing material would gain even greater acceptance in the marketplace, if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid called mesophase. The presence of this ordered structure prior to carbonization is considered to be significant in determining the fundamental properties of any carbon artifact made from such a carbonaceous pitch. Indeed, the ability to generate high optical anisotropicity during the early processing steps is accepted particularly in carbon fiber production as a prerequisite to the formation of high quality products. Therefore, one of the first requirements of any feedstock material suitable for carbon artifact manufacture and particularly carbon fiber production is its ability to be converted to a highly optically anisotropic material.

In addition to being able to develop a highly ordered structure, suitable feedstocks for carbon artifact manufacture and particularly carbon fiber manufacture should have relatively low softening points, rendering them suitable to being deformed, shaped or spun into desirable articles. For carbon fiber manufacture, a suitable pitch which is capable of generating the requisite highly ordered structure must also exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke or other infusable materials and/or undesirably high softening point components generated prior to or at the spinning temperatures are detrimental to processability and are believed to be detrimental to product quality. For example, U.S. Pat. No. 3,919,376 discloses the difficulty in deforming pitches which undergo coking and/or polymerization near their softening temperatures.

Another important characteristic of a feedstock for carbon artifact manufacture is its rate of conversion to suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at temperatures particularly in excess of about 425° C., incipient coking and other undesirable side reactions do take place which can be detrimental to the ultimate product quality.

It has become known that typical graphitizable carbonaceous pitches contain a separable fraction which possesses very important physical and chemical properties insofar as carbon fiber processing is concerned. Indeed, the separable fraction of typical graphitizable carbonaceous pitches exhibits a softening range or viscosity suitable for spinning and has the ability to be converted at temperatures in the range generally of about 230° C. to about 400° C. to an optically anisotropic deformable pitch. Unfortunately, the amount of separable fraction present in well known commercially available graphitizable pitches such as Ashland 240 and Ashland 260, to mention a few, is exceedingly low. For example, with Ashland 240, no more than about 10% of the pitch constitutes a separable fraction capable of being thermally converted to a liquid crystalline phase.

It has also become known that the amount of the fraction of typical of typical graphitizable carbonaceous pitches which exhibits a softening point and viscosity suitable for spinning and has the ability to be rapidly converted at low temperatures to highly optically anisotropic deformable pitch can be increased by heat soaking the pitch, for example, at temperatures in the range of 350° to 450° C., until spherules visible under polarized light begin to appear in the pitch. The heat soaking or melting of such pitches has generally resulted in an increase in the amount of the fraction of the pitch capable of being converted to an optically anisotropic phase. Indeed, yields up to about 48% of a separable phase were obtained upon heat treatment of the Ashland 240, for example.

It is disclosed, in U.S. Pat. No. 4,219,404 that polycondensed aromatic oils present in isotropic carbonaceous feedstocks are generally detrimental to the rate of formation of highly optical anisotropic material in such feedstocks when heated at elevated temperatures and such polycondensed aromatic oils can be readily removed by techniques such as vacuum or steam stripping or the like. Heat soaking such pitches in which at least a portion of the amount of aromatic oils have been removed results in high yields of a feedstock suitable for carbon artifact manufacture. The patent further discloses that such a pitch can thereafter be treated with a solvent, or mixture of solvents which will result in the separation of the solvent insoluble fraction of the pitch which is highly anisotropic or capable of being converted to a highly anisotropic phase or capable of being converted to a highly anisotropic phase and which has a softening point and viscosity at temperatures in the range of about 250° C. to about 400° C. which is suitable for spinning.

In European patent application No. 0026647, the obtention of a mesophase pitch containing at least 70% by weight mesophase having a particular molecular weight distribution by the use of physical operations without chemical operations is disclosed. The physical operations include solvent extraction and a sequence of solvent extraction steps. Example 14 of this patent application demonstrates a sequence of solvent extractions in which a petroleum pitch was sequentially extracted with toluene, petroleum ether and toluene again.

It has now been discovered that the molten carbonaceous residue of petroleum origin of the aforementioned U.S. Pat. No. 4,219,404, contains a particular fraction which can be recovered by suitable means and converted into a precursor feedstock material that exhibits a softening point and viscosity which is suitable for spinning and has the ability to be rapidly converted at low temperatures to highly optically anisotropic deformable pitch.

It is, accordingly, the object of this invention to provide a method of obtaining a pitch having a softening point and viscosity suitable for spinning and to provide spun products from such a pitch. This and other objects of the invention will become apparent to those skilled in the art from the following detailed description of the invention.

SUMMARY OF THE INVENTION

This invention relates to the preparation of a feedstock for carbon artifact manufacture and to the feedstock and spun products therefrom. A deoiled, molten carbonaceous residue of petroleum origin is subjected to a two stage extraction with an organic solvent system, the first stage being the solubilization of the residue in the solvent and the separation of insolubles therefrom, and the second stage being the precipitation of the residue from the solvent. Thereafter, the precipitated residue is thermally treated. The resulting thermally treated fraction can be spun into carbon fibers.

DESCRIPTION OF THE INVENTION

As used herein, the term "pitch" means highly aromatic petroleum pitches and pitches obtained as by-products in the gas oil or naphtha cracking industry, pitches of high carbon content obtained from petroleum cracking and other substances having properties of aromatic pitches produced as by-products in various industrial chemical processes. "Petroleum pitch" refers to the residum carbonaceous material obtained from the thermal, steam and catalytic cracking of petroleum distillates including hydrodesulfurized residum of distilled and cracked crude oils.

Pitches generally having a high degree of aromaticity are suitable for carrying out the present invention. High boiling, highly aromatic streams containing such pitches or that are capable of being converted into such pitches are also employable. One example of such streams are catalytic cracker bottoms. Additionally, various commercially available pitches having high aromaticity and high carbon content which are known to form mesophase in substantial amounts during heat treatment at elevated temperatures can also be used. Examples of the latter include Ashland 240 and Ashland 260. Typical characteristics of an atmospheric pressure heat soaked commercial pitch (Ashland 240) and two vacuum heat soaked cat cracker bottom pitches are set forth in Table I:

TABLE I

| | Ashland 240 Pitch | CCB-Pitch (I) | CCB-Pitch (II) |
|---|---|---|---|
| Soft Point (°C.) | 100 | 115 | 140 |
| Toluene Insolubles % (TiSEP Method) | 10.0 | 10.3 | 29.0 |
| Quinoline Insolubles (ASRM @ 75° C.) | 7.0 | 6.0 | 22 |
| Ash (%) | 0.1 | 0.1 | 1.7 |
| Glass Transition Temperature of Toluene Insolubles (°C.) | 281 | 274–294 | 273 |
| Distillate Oil Content (%) | 39.0 | 31.0 | 26.0 |
| Carbon (%) | 89.96 | 91.63 | — |
| Hydrogen (%) | 5.40 | 5.37 | — |
| C/H Atomic Ratio | 1.39 | 1.42 | 1.65 |
| Aromatic Carbon (Atom %) | 84 | 78 | 84 |
| Aliphatic Protons (%) | 5 | 12 | 5 |
| Benzylic Protons (%) | 37 | 35 | 37 |
| Aromatic Protons (%) | 57 | 50 | 57 |

The foregoing pitches contain an aromatic oil which is detrimental to the rate of formation of the highly optical anistropic phase when such pitches are heated at elevated temperatures. In accordance with the aforementioned U.S. Pat. No. 4,219,404, the oil is removed and the pitch is melted to obtain the pitch feed which is subjected to the two-stage extraction process of the present invention. In general, the pitch is treated so as to remove greater than 40%, and especially from about 40 to about 90% of the total amount of the distilable oil present in the pitch, although in some instances it might be desirable to remove substantially all of the oil in the pitch. Preferably, about 65–80% of the oil in the pitch is removed.

One technique which can be used is to treat the isotropic carbonaceous pitch under reduced pressure and at temperatures below the cracking temperature of the pitch. For example, the pitch can beheated to a temperature of about 250°–380° C. while applying vacuum to the pitch of about 0.1–25 1 mmHg pressure. After an appropriate proportion of the oil has been removed, the pitch is cooled and collected.

There is a fraction of the deoiled pitch (oil-free pitch) which is particularly suitable for being processed into carbonfibers. This fraction is characterized by having a reverse solubility curve in an organic solvent system which has a solubility parameter of about 8–9.5 or somewhat higher. The organic solvent system can be a single solvent or a combination of solvents. Typically such solvent, or mixture of solvents, include aromatic hydrocarbons such as benzene, toluene, xylene, tetrahydrofuran, chlorobenzene, trichlorobenzene, dioxane, dimethylacetamide, tetramethylurea, and the like, and mixtures of such aromatic solvents with aliphatic hydrocarbons such as toluene/heptane mixtures. The solvent system has a solubility parameter of about 8–9.5 and preferably about 8.7–9.2 at 25° C. The solubility parameter of a solvent or a mixture of solvents is equal to $$(Hr-RT)/V^{\frac{1}{2}}$$

in which $H_v$ is the heat of vaporization of the material, R is the molar gas content, T is the temperature in K and V is some molar volume. For a further description of the solubility parameter, reference may be had to Hildebrand, et al, "Solubility of Non-Electrolytes", 3rd Ed, Reinhold Publishing Co., N.Y. (1949) and "Regular Solutions", Prentice Hall, N.J. (1962). The solubility parameters at 25° C. for hydrocarbons in commercial $C_6$–$C_8$ solvents are: benzene, 8.2; toluene, 8.9; xylene, 8.8; n-hexane, 7.3; n-heptane, 7.4; methylcyclohexane, 7.8; bis-cyclohexane, 8.2. Among the foregoing solvents, toluene is preferred. As is well known, solvent mixtures can be prepared to provide a solvent system with the desired solubility parameter. Among mixed solvent systems, a mixture of toluene and heptane is preferred having greater than about 60 volume percent toluene, such as, e.g., 60% toluene/40% heptane and 85% toluene/15% heptane.

In order to take advantage of the reverse solubility curve characteristic of the desired fraction, the distillable, oil-removed pitch is first contacted with a quantity of the organic solvent system in which it is soluble. For example, the pitch to solvent weight ratio can vary from about 0.5:1 to about 1:0.5. The solubilization can be effected at any convenient temperature although refluxing is preferred. A portion of the deoiled pitch is insoluble in the organic solvent system under these conditions and can be easily separated therefrom, for example, by filtration. The insoluble materials generally include inorganic materials (ash), coke particles and a very high molecular weight pitch fraction. The amount of insolubes can vary condsiderably but are usually about 0.5–5 wt.%. The variation in the amount of insolubles usually depends upon the particular pitch treated, the particular solvent used, the pitch:solvent ratio, the temperature at which the extraction is effected and any filtration adjuvants which may be used.

In order to recover the desired fraction which is now solubilized, the quantity of the organic solvent system is increased to an amount sufficient to precipitate the desired fraction. As a general rule, the pitch to solvent ratio is increased to about 1:2 to 1:16. The temperature at which this second phase of the extraction process is effected can be any convenient temperature but, as before, is preferably carried out at reflux. If desired, the organic solvent system used in the first and second phases of the extraction process can be different.

The solvent insoluble fraction can be readily separated by techniques such as sedimentation, centrifugation, filtration and the like. Thereafter, the solvent insoluble fraction of the pitch prepared in accordance with the two-stage extraction process is thermally treated for a short period of time in order to reduce volatiles and increase the liquid crystal fraction in the precursor. The thermal treatment step can conveniently carried out at atmospheric pressure in an inert atmosphere such as nitrogen, for example, at temperatures in the range of about 250° C. to about 450° C. Conveniently, the dried solvent insoluble fraction obtained as a result of the second stage of the extraction process can be pelletized by extrusion at 350°–400° C. in order to homogenize and melt the desired pitch while effecting the thermal treatment.

The pelletized precursor can be spun into carbon fiber in accordance with conventional practice. For example, the pelletized precursor can be spun using an extruder and a spinnerette having, e.g., 200 holes or more. The green fiber is then oxidized and carbonized at a high temperature to produce a carbon fiber which will exhibit satisfactory tensile strength, e.g., about 340+ Kpsi.

In order to further illustrate the process of this invention, reference can be had to the following examples which are illustrative only and are not meant to limit the scope of the invention.

EXAMPLES 1, 2, 3 AND 4

PRODUCTION OF VACUUM DISTILLED PETROLEUM PITCH

A commercial petroleum pitch (Ashland 240) or a cat cracker bottom (cf Table I) was introduced into a reactor which was electrically heated and equipped with a mechanical agitator, nitrogen injection system and distillate recovery system. The pitch or cat cracker bottom was melted by heating to 250° C. under nitrogen, and agitation was commenced when the pitch or bottom had melted. The pressure was reduced in the reactor to about 15 mmHg absolute. Heating was continued under the reduced pressure and the agitation was continued. When a desired amount of the oil was distilled, the remaining stripped pitch was cooled to about 300° C., discharged and ground. The characteristics of the resulting vacuum distilled petroleum pitches are shown in Table II:

TABLE II

| Example | Feed | % Oil Removed* | Pyridine Insolubles (Reflux %) | Toluene Insolubles (Reflux %) | Quinoline Insolubles (% at 75° C.) | Melting Point (°C.) |
|---|---|---|---|---|---|---|
| 1 | Ashland Pitch 240 | 25(64) | 3.5 | 13.9 | 0.00 | 222 |
| 2 | Ashland Pitch 240 | 35(90) | 3.5 | 17.1 | 0.00 | 211 |
| 3 | CCB(I) | 31(100) | 3.2 | 14.0 | 0.100 | — |
| 4 | CCB(II) | 37(142) | 14.2 | 37.0 | 1.8 | 202 |

*Based on total weight of pitch treated
(% based on amount of distillable oil in parenthesis)

EXAMPLES 5 THROUGH 9

PRECURSOR PREPARATION BY EXTRACTION OF VACUUM-STRIPPED PETROLEUM PITCHES

Ground vacuum-stripped petroleum pitches were mixted with an equal weight of toluene (i.e. a 1:1 pitch:solvent ratio) and a small amount of a filter aid (celite) and introduced into a reactor equipped with an electrical heating and agitation system. The mixtures were heated at reflux for 1 hour under nitrogen and then filtered at 90°–100° C. through a sparkler filter system heated prior to filtration to about 90° C. The filtrates, which contain the desired pitch fraction, was pumped into a second vessel and mixed with excess toluene (increasing pitch:toluene ratio to 1:8) to reject the desired pitch fraction from the solution. The mixtures were refluxed for 1 hour and allowed to cool to room temperature (4–5 hours). The precipitated pitch fractions were then separated using a centrifuge, washed with toluene and finally with n-heptane. The wet cake was dried in a rotary vacuum drier and stored under nitrogen. The resulting precursor characteristics are set forth in Table III below:

TABLE III

| Example | Feed (Pitch of Example) | Precursor Yield (%) | Tg (°C.) | n-Heptane Insolubles (%) | Pyridine Insolubles (Reflux %) | Toluene Insolubles (Reflux %) | Ash (%) | Viscosity @ 375–365 | | Volatiles 370° C. (%) | Aromatic Carbon Atom (%) |
|---|---|---|---|---|---|---|---|---|---|---|---|
| 5 | 1 | 11.4 | 265 | 99.9 | 32.5 | 76.4 | 0.088 | — | — | 0.9 | — |
| 6 | 1 | 17.0 | 252 | 100.0 | 32.5 | 77.1 | 0.085 | 444 | 1131 | 0.8 | — |
| 7 | 1 | 17.8 | 243 | 99.7 | 29.5 | 77.4 | 0.005 | — | — | 0.8 | — |
| 8 | 1 | 22.8 | 251 | 99.3 | 27.5 | 72.2 | 0.005 | — | — | 0.8 | 87 |
| 9 | 4 | 17.0 | — | — | 28.0 | 74.0 | 0.005 | — | — | 0.8 | — |

EXAMPLE 10

PELLETIZATION OF PRECURSOR

A blend of the precursor materials obtained in Examples 6, 7 and 8 were extruded at 375° C. in order to homogenize the blend prior to spinning and to pelletization. The blend had a glass transition temperature of 235° C., a softening point of 350° C., an aromaticity carbon atom content of 88%, 30.5% pyridine insolubles, 77.8% toluene insolubles, no ash, a viscosity of 696 cps at 335° C. (444 cps at 360° C.) a C/H atomic ratio of 1.66 and an optical anisotropy of 100%.

EXAMPLES 11 AND 12

PRODUCTION OF CARBON FIBER

The pelletized precursor prepared in Example 10 was spun using a 200 hole spinnerette. The pellets were melted at 360°–380° C. and a pressure of 100–1000 psi and spun into fibers of two different diameters which were wound on spools, oxidized with air then carbonized to produce the carbon fiber. The characteristics of the carbon fibers are set forth in Table IV:

TABLE IV

| | Fiber Diameter (μ) | Tensile Strength (Kpsi) | Modulus KKpsi | Strain/Fail Ratio |
|---|---|---|---|---|
| Example 11 | 10.2 | 341 | 36.7 | 0.94 |
| Example 12 | 9.4 | 354 | 36.9 | 0.96 |

Various changes and modifications can be made in the process and products of this invention without departing from the spirit and scope thereof. The various embodiments which have been described herein were for the purpose of illustrating the invention but were not intended to limit it.

What is claimed is:

1. A process for preparing a pitch suitable for spinning into carbon fibers from a carbonaceous residue having a high degree of aromaticity and high carbon content obtained from thermal, steam and catalystic cracking of petroleum distillates which consists of the following sequential steps:

(a) heating said carbonaceous residue to elevated temperatures under vacuum to effect deoiling;

(b) subjecting the resulting vacuum deoiled molten carbonaceous residue to a two-stage separation process with an organic solvent system having a solubility parameter of about 8–9.5, the first step being the solubilization of a fraction of said residue in said solvent and the separation of insolubles therefrom, the second stage being the precipitation of said fraction from said solvent; and (c) then thermally heating the resulting precipitated fraction at a temperature of from about 250°–450° C.

2. The process of claim 1 in which the residue: solvent system ratio in the first stage is about 0.5:1–1:0.5.

3. The process of claim 2 in which the residue:solvent system ratio in the second stage is about 1:2–1:16.

4. The process of claim 1 in which the residue:solvent system ratio in the second stage is about 1:2–1:16.

5. The process of claim 1 in which the solvent parameter is about 8.7–9.2.

6. The process of claim 5 in which said organic solvent system is a single solvent consisting of toluene.

7. The process of claim 6 in which said residue subjected to extraction has had at least 40% of its distillable oil removed therefrom.

8. The process of claim 7 in which the residue:solvent ratio in the first stage is about 0.5:1–1:0.5 and the residue:solvent system ratio in the second stage is about 1:2–1:16.

9. The process of claim 8 in which the thermal treatment of the precipitated fraction is effected by extruding said precipitated fraction at 350°–400° C. to form pellets.

10. The process of claim 1 in which said residue subjected to extraction has at least 40% of its distillable oil removed therefrom.

* * * * *